United States Patent [19]

Griffin et al.

[11] 4,451,760

[45] May 29, 1984

[54] LONG LIFE INCANDESCENT TUNGSTEN-HALOGEN LAMP

[75] Inventors: Robert M. Griffin, South Hamilton; Roy C. Martin, Salem, both of Mass.

[73] Assignee: GTE Products Corporation, Stamford, Conn.

[21] Appl. No.: 372,508

[22] Filed: Apr. 28, 1982

[51] Int. Cl.[3] ..... H01K 1/08; H01K 1/56

[52] U.S. Cl. ..... 313/557; 313/559; 313/579

[58] Field of Search ..... 313/579, 559, 557

[56] References Cited

U.S. PATENT DOCUMENTS 2,444,423 7/1948 Braunsdorff ..... 313/557
3,466,489 9/1969 Audesse et al. ..... 313/579
3,956,659 5/1976 Almer et al. ..... 313/579

FOREIGN PATENT DOCUMENTS 2067832 7/1981 United Kingdom ..... 313/557

*Primary Examiner*—Palmer C. Demeo
*Attorney, Agent, or Firm*—William H. McNeill

[57] ABSTRACT

Life expectancy, through reduction of filament sag and halogen corrosion of tungsten filaments, is greatly increased for tungsten-halogen lamps by including within the filament environment a quantity of copper. The copper can be present as one of the lead-in wires; a plating on the lead-in wires; a separate copper insert; or a coating on the filament. It is believed the copper acts as an oxygen getter.

8 Claims, 4 Drawing Figures

LONG LIFE INCANDESCENT TUNGSTEN-HALOGEN LAMP

CROSS-REFERENCES TO RELATED APPLICATIONS

Ser. Nos. 372,512; 372,519; 372,594, now U.S. Pat. Nos. 4,430,599; and 372,518, filed concurrently herewith and assigned to the assignee of the instant application, contain related subject matter.

TECHNICAL FIELD

This invention relates to incandescent lamps and more particularly to tungsten-halogen incandescent lamps. Still more particularly it relates to lamps of the latter variety containing therewithin means to prevent filament sagging and filament corrosion due to halogen action, thus allowing long life and the ability to be lighted in any physical orientation.

BACKGROUND OF THE INVENTION

The majority of incandescent lamps today use a filament made from tungsten wire which can be of the single or coiled coil design. When initially energized to incandescence, the filament will both metallurgically recrystalize and physically sag under gravitational attraction.

Coiled coil filaments sag more than single coils and fine wire sags more than heavy wire.

In the vertical position sag is characterized by a collapsing of turns with open turns at the top and compression at the bottom. Sag in the horizontal position is characterized by the formation of one or more catenaries depending on the number of filament support wires.

The preliminary sag in tungsten filaments has never been completely eliminated. However, it can be signficantly reduced by employing a controlled heating process at the time of initial lightup. Two different processes for doing this are now in common use and are briefly described as follows.

1. Pre-stabilizing is a process used mainly on coiled coil filaments for halogen lamps. It involves raising the coil temperature above 2400° C. in vacuum prior to removing the primary mandrel and while the secondary coiling is mounted on a threaded rod. The result is a brittle coil which requires hand mounting. This, plus the pre-stabilizing process make for a very expensive coil. However, preliminary sag at initial coil lightup is minimal.
2. Flashing is an alternate method of stabilizing the filament. It is done after the coil is mounted in the lamp and can be performed either before or after tipoff. Since the filament as received is not brittle, it does not require hand mounting and can therefore be mounted inexpensively via high speed automatic equipment. Initial lightup under these conditions results in more preliminary sag than on pre-stabilized coils.

Unfortunately, the filament in an incandescent lamp will continue to sag during subsequent lamp operation in spite of pre-stabilizing or flashing. This is generally attributed to a slippage at the grain boundaries. The condition is known to be aggravated by the presence of oxygen in the gaseous state. This accounts for a higher degree of sag in halogen lamps because the halogen regenerative cycle retains a higher percentage of oxygen in the gaseous state than there is in a non-halogen incandescent lamp. Generally, the sag in non-halogen incandescent lamps is not severe because most of the residual oxygen is tied up on the bulb wall as tungsten-oxide, a colorless solid condensate.

Thus, a sufficient quantity of oxygen is not available in the gaseous state to promote sag.

However, in halogen lamps this secondary sag can be a serious problem due to the fact that any oxides present can be reduced by the halogen additive (HBr in this case) which promotes the presence of free oxygen in the gaseous state.

As was the case with preliminary sag, fine wire filaments of the coiled coil configuration are especially susceptible to severe secondary sag in a halogen atmosphere. Also, chemical corrosion of the wire in the cooler sections of the filament results in a significant reduction in life as caused by thinning and premature arcing. This is more pronounced in fine wire than it is in heavy wire.

These problems become even more aggravated in the case of a tungsten-halogen lamp employing a low wattage, line voltage, coiled coil filament. An example of such a coiled coil would be one rated at 100 watts and 120 volts. Such a coil is formed from fine tungsten wire (12.5 mg/200 mm with a diameter of 0.0025 inches) and filament sag and short life due to the presence of the halogen would be a serious problem.

The use of halogen in an incandescent lamp generally allows for an envelope which is drastically reduced from the size that would be required by a non-halogen version of the same wattage. Specifically, the 100 watt filament described above is normally sealed in an A19 glass bulb under non-halogen conditions but can be sealed in a T5 glass envelope when halogen is added. The relative volumes of these two bulbs are:

1. A19=130 cc,
2. T5=5.2 cc.

The use of this drastically smaller T5 envelope provides for higher fill pressures which in turn results in a lamp performance increase. However, the filament is now significantly closer to the bulb wall of the T5 and filament sag while burning in any position other than the vertical results in the coil moving closer to the wall. The result is a local increase in bulb wall temperature with a corresponding increase in outgassing of the glass which can be deleterious to lamp performance. In the most severe case, the filament can (and has) sagged to the point where it makes contact with the bulb wall. The result is thermal cracking or melting of the bulb wall which terminates lamp life prematurely.

There are numerous techniques now in use attempting to solve the problem of sag in halogen lamps of this type. However, each one introduces new problems which forces a compromise with respect to lamp performance. Some of the more widely used techniques are briefly described here.

1. Center Support—Sag reduction can be restricted significantly by using a third wire which loops around the center of the coil and is electrically isolated from the two end lead wires. Sag in any position except vertical will result in two catenaries whose displacement from the original coil center line is less than that of an unsupported single catenary. However, contact between coil and support results in a local cool spot which then becomes the center of increased halogen activity with its associated tungsten corrosion. The coil will ultimately fail prematurely due to the accelerated thinning in the area of contact with the center support wire. Also, a center support makes lamp manufacture more difficult and costly.

2. Pre-Stabilized Coil—As previously described, this process results in less overall sag but is restricted to hand mounting due to coil embrittlement. This latter restriction results in a significant increase in manufacturing costs which is intolerable in low cost lamp types, such as would be suitable for general home illumination.

3. Methane Light Up—This is a well-known process employed during the lamp exhaust cycle whereby the filament is energized in an atmosphere of nitrogen and methane ($CH_4$). The literature alludes to reduced coil sag as a result and attributes this benefit to a reaction between the tungsten filament and the carbon in the methane. However, tests run on a 100 watt, 120 volt coil, such as that described above, resulted in absolutely no reduction in coil sag when compared with control lamps which were not lighted in methane.

4. Other Halides—The halogen additive often used is Hydrogen Bromide (HBr). It is considered by some lamp manufacturers to be too corrosive and therefore less desirable than the carbonaceous halides. Tests run fail to show any advantages to using this type of halide ($CH_2Br_2$, for example). A serious defect arises when using this gas. The result is a significant attenuations of light output which is caused by a carbon layer deposited on the inner bulb wall during initial lightup when the $CH_2Br_2$ is decomposed into a more elemental form.

5. Reduced Halogen Content—It has been shown by tests that a reduction in halogen content in the fill gas will give rise to a corresponding reduction in filament sag and corrosion. Unfortunately, it will also result in an increase in the percentage of lamps which will turn black prematurely due to failure of the halogen regenerative cycle. Lamp blackening of any halogen lamp constitutes lamp failure even if the filament continues to burn. No reputable lamp manufacturer would tolerate such a condition.

6. Condenser Discharge Flashing—This is a process which attempts to achieve the results displayed by a pre-stabilized filament while circumventing the brittle coil/hand mount problems of the latter. It involves stabilizing the filament after mounting either during the exhaust cycle or after tipoff. A condenser is used to discharge a high energy pulse through the coil. The pulse duration is very short compared to the conventional series-ballast flashing process used by many lamp manufacturers. This shorter time duration significantly reduces the heat sinking effect on the coil's metallurgical structure by the lead-in clamps. Thus, the coil is allowed to stabilize more completely in the clamp area from where much of the sag problem emanates. However, it is felt that this method will achieve, at best, only a portion of the effect desired, and that at increased cost of manufacture.

7. Low Sag Coil Design—It has been demonstrated that the coil design which exhibits the least amount of sag is one which has the tightest T.P.I. and lowest mandrel to wire (coil) ratio with respect to both the primary and secondary windings of the CC8 filament. All of this must be done, however, within the allowable limits of prescribed coil manufacturing practice. Like condenser discharge flashing, it is felt that low sag coil design will achieve only a portion of the desired effect.

DISCLOSURE OF THE INVENTION

It is, therefore, an object of this invention to obviate the disadvantages of the prior art.

It is another object of the invention to enhance tungsten-halogen lamps.

Yet another object of the invention is to significantly reduce primary and secondary filament sag in incandescent lamps.

Still another object of the invention is the reduction of halogen corrosion of the filament of a tungsten-halogen filament.

Another, more specific object of the invention is the provision of means within the envelope for providing reduced sag and corrosion of the filament.

These objects are accomplished, in one aspect of the invention, by the provision, within the envelope of an incandescent lamp, of a copper source. The copper can be present as one of the internal lead-ins of the lamp.

Alternatively: a copper flag can be attached to a non-copper lead-in; a separate copper wire can be sealed in the press in a manner to project into the interior of the envelope; or the tungsten coil itself can be copper plated.

The invention allows the fabrication of halogen lamps in wattage varieties and voltage requirements suitable for replacement of the usual incandescent lamps normally used for home lighting. The lamps are characterized by the excellent lumen maintenance (percentage of light output retained from original light output as the lamps age) associated with lamps employing the halogen regenerative cycle. Excellent life ratings are also achieved whether the lamp is burned with the filament in vertical or horizontal orientation.

The mechanism through which the copper effects these results is not thoroughly understood, though a theory has been established which appears plausible. It states that the copper acts as a chemical getter for oxygen within the lamp.

It is well known that oxygen promotes both filament sag and halogen activity; therefore, a reduction in each would seem to signify a corresponding reduction in the amount of available oxygen. It is also known that copper has an affinity for oxygen at elevated temperature, specifically those temperatures at which the lamp operates. Thus, the Copper/Oxygen Getter Theory.

BEST MODE FOR CARRYING OUT THE INVENTION

For a better understanding of the present invention, together with other and further objects, advantages and capabilities thereof, reference is made to the following disclosures and appended claims taken in conjunction with the above-described drawings.

Figure 1:
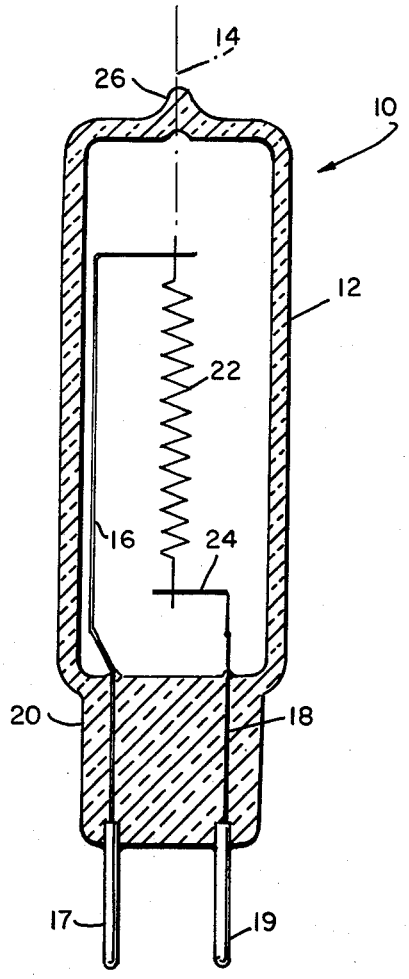
FIG. 1 is a diagrammatic view of a lamp employing an embodiment of the invention.

Referring now to the drawings with greater particularity, there is shown in FIG. 1 a lamp 10 having a light transmitting, glass envelope 12 having a longitudinal axis 14. Envelope 12 preferably is formed from T5 hard glass tubing; for example, a borosilicate or aluminosilicate glass.

Two lead-in wires 16 and 18 are sealed in envelope 12 as at press 20 and project internally and externally thereof. One of the lead-in wires, for example 16, is relatively long and extends substantially the length of envelope 12, while the other lead-in wire 18 is shorter. A tungsten filament 22, which can be in the form of a coiled coil designed for 100 watt, 120 volt operation, is attached to the lead-in wires 16 and 18 and extends substantially along the longitudinal axis 14.

The lead-in wires 16 and 18, at least in the area of press 20, must be of a material, such as molybdenum or a material, which will form a hermetic, strain free seal with the hard glass. In lamps designed for operation at about 100 watts or more, the internal portion of long head-in 16 also is preferably molybdenum or tungsten; however, the internal portion 24 of short lead-in 18 is copper, in the embodiment of FIG. 1. The external portions 17 and 19 of the lead-in wires may be nickel plated steel or other suitable material.

When lamp 10 is a halogen lamp and the halogen is introduced into the lamp in combination with hydrogen, e.g., as hydrogen bromide, then the copper employed must be OFHC (Oxygen Free High Conductivity). The use of OFHC copper is mandated in the latter instance because other forms of copper suffer embrittlement in the presence of hydrogen.

It also is possible to make the long lead-in wire 16 of copper; however, then the lamp can only be effectively burned with the filament vertical. This condition exists because of the nature of copper. While copper has a melting temperature of 1083° C., its strength is greatly reduced at temperatures well below this level. Tests have shown that if small volume lamps with a long lead-in wire of copper are burned in a horizontal position, with the lead-in above the filament, the temperatures generated are sufficient to cause the lead-in to bend, thus allowing the filament to sag to the bulb wall and cause lamp failure. This problem does not exist when it is the short lead-in that is copper.

Lamp 10 also is provided with the usual tubulation 26 (shown tipped off in the drawings) whereby air is exhausted and the requisite fill gas introduced. In a preferred embodiment the fill gas comprises, by volume, about 88% krypton, 11.79% nitrogen, and 0.21% hydrogen bromide at a pressure of about 5 atmospheres absolute at room temperature.

In another embodiment of the invention either one or both of the lead-in wires can be copper plated. While this may be more expensive than the support copper lead-in, it is perfectly workable.

Figure 2:
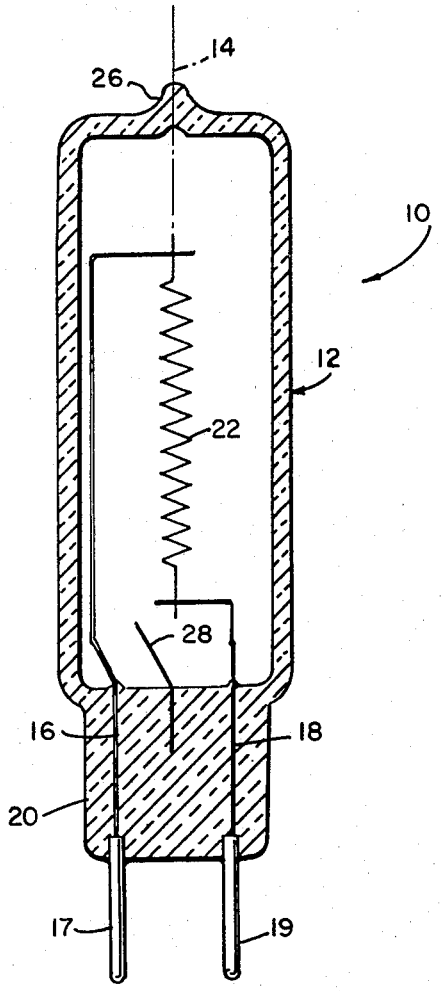
FIG. 2 is a diagrammatic view of a lamp employing a second embodiment of the invention.

Another embodiment of the invention is shown in FIG. 2 wherein copper is provided within lamp envelope 12 by means of a copper insert 28 which is sealed in press 20, preferably between the two lead-in wires 16 and 18. Since the insert 28 does not extend through the press 20, it is not necessary that a hermetic seal be formed between it and the glass.

Figure 3:
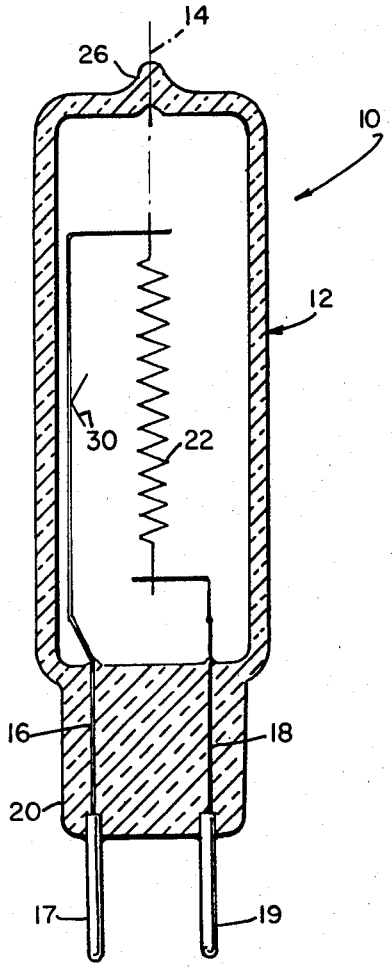
FIG. 3 is a similar view illustrating another embodiment of the invention.
Figure 4:
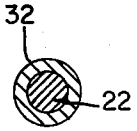
FIG. 4 is a sectional view of a tungsten coil embodying another aspect of the invention.

Yet another embodiment is shown in FIG. 3 wherein the copper takes the form of a flag 30 attached to the long lead-in wire 16. The flag 30 can be V shaped and can be wire or foil.

In another embodiment, the copper can be introduced into lamp 10 by copper coating the filament 22. Batch coating filaments by an electroless dip process provides an economical method. Two methods to energize the filament with a copper coating have been formulated.

1. The lamp with copper coated coil is exhausted, back-filled with inert gas plus halogen and then tipped off. After this the filament is energized in the usual manner employed for stabilizing the crystal structure. The result is a light copper swirl deposited on the bulb wall above the filament. Subsequent operation of the lamp results in a reaction between this copper swirl and the halogen gas which causes the swirl to vaporize and disperse within the lamp after a short period of operation.

2. A second process is to energize the filament on the exhaust machine prior to tipoff while it is backfilled with a mixture of inert plus halogen gas. After light up the gas is then pumped from the lamp which is now ready for final fill and tipoff. There is no copper visible within the lamp after tipoff. However, the same beneficial effect from copper results during subsequent lamp operation. A typical process specification for this method is as follows.

Light up voltage—120 Volts,

Light up duration—30 Seconds,

Back Fill Gas Mix—88% Argon + 11.7% $N_2$ + 0.30% HBr,

Back Fill Gas Pressure—900 torr absolute.

A typical quantity of copper for a 100 watt, 120 volt coil would be 1.3% copper by weight of the coil. Another method of including copper within the lamp 10 is to coat the filament 22 with a slurry of copper bromide ($CuBr_2$) dispersed in ethyl alcohol. This technique is described in German Pat. No. DE 28 03 122 as being a method of introducing bromine in solid form to reduce the corrosive effects of the gas on equipment. This latter patent, however, teaches processing the lamp in a manner to remove the copper.

While there have been shown and described what are at present considered to be the preferred embodiments of the invention, it will be apparent to those skilled in the art that various changes and modifications can be made without departing from the scope of the invention as defined by the appended claims.

We claim:

1. A tungsten-halogen lamp comprising: a light transmitting, hermetically sealed, glass envelope having a longitudinal axis; two lead-in wires sealed in said envelope and extending internally and externally thereof, one of said lead-in wires being long and the other being short, and said lead-in wires being substantially molybdenum or tungsten; a tungsten filament attached to said lead-in wires and extending substantially along said longitudinal axis; a fill gas within said envelope, said fill gas comprising krypton, nitrogen and a halogen; and means within said lamp for reducing sag and halogen corrosion of said filament, said means being copper; said copper being attached to said long lead-in wire.

2. The lamp of claim 1 wherein said lead-in wires comprise about 97% molybdenum and about 3% tantalum.

3. A tungsten-halogen lamp comprising: a light transmitting, hermetically sealed, glass envelope having a longitudinal axis; two lead-in wires sealed in said envelope and extending internally and externally thereof; a tungsten filament attached to said lead-in wires and extending substantially along said longitudinal axis, a fill gas within said envelope, said fill gas comprising krypton, nitrogen and a halogen; and means within said envelope for reducing sag and halogen corrosion of said filament, said means comprising a copper wire insert sealed in said envelope and extending therewithin.

4. The lamp of claim 3 wherein said halogen is bromine.

5. The lamp of claim 4 wherein said bromine is introduced into said lamp as hydrogen bromide.

6. A tungsten-halogen lamp comprising: a light transmitting, hermetically sealed, glass envelope having a longitudinal axis; two lead-in wires sealed in said envelope and extending internally and externally thereof; a copper plated tungsten filament attached between said internal lead-in wires and extending substantially along said longitudinal axis; and a fill gas comprising krypton, nitrogen and a halogen within said envelope; said copper being vaporizable within said envelope and remaining therewithin to reduce sag and halogen corrosion of said filament during subsequent operation of said lamp.

7. The lamp of claim 6 wherein said halogen is bromine.

8. The lamp of claim 7 wherein said bromine is introduced into said lamp as hydrogen bromide.

* * * * *